United States Patent [19]

Moore, Sr. et al.

[11] Patent Number: 4,776,512

[45] Date of Patent: Oct. 11, 1988

[54] MAIL CHUTE POUCH

[76] Inventors: Lee P. Moore, Sr.; Mary A. Moore, both of 20452 Cheyenne, Detroit, Mich. 48235

[21] Appl. No.: 69,106

[22] Filed: Jul. 2, 1987

[51] Int. Cl.[4] ..... A47G 47/12

[52] U.S. Cl. ..... 232/19; 232/43.2; 248/101

[58] Field of Search ..... 232/17-23, 232/43.2; 248/99, 101; 383/66, 67

[56] References Cited

U.S. PATENT DOCUMENTS

| | | | |
|---|---|---|---|
| 1,992,849 | 2/1935 | Walter | 383/66 X |
| 2,128,689 | 8/1938 | Bingham | 383/67 X |
| 4,069,965 | 1/1978 | Maddox | 232/43.2 |
| 4,694,503 | 9/1987 | Hydorn | 248/99 X |

*Primary Examiner*—Robert W. Gibson, Jr.

*Attorney, Agent, or Firm*—Charles W. Chandler

[57] ABSTRACT

A mail receptacle is disclosed in the form of a pouch which attaches to the periphery of a mail slot on the interior of a door or wall of a residence or building to receive mail therein which is inserted through the slot. Part or all of the pouch material is transparent to provide a visual indication of mail delivery. A zipper opening is provided in the pouch to retrieve delivered mail from the pouch. A flap is provided as extra protection against air drafts.

7 Claims, 1 Drawing Sheet

MAIL CHUTE POUCH

BACKGROUND OF THE INVENTION

This invention relates to a residential U.S. mail receptacle and more particularly to a mail receptacle in the form of a pouch or sack which is adapted to be retained, within a residence or building, adjacent a mail chute slot in an outer wall or door of the building or residence to receive and retain mail which has been passed through the slot.

The United States Postal Service, which is a USA Government Agency, is charged with the responsibility of delivering correspondence and other printed or written materials referred to as mail, between persons who reside in different geographical locations in the U.S.A. Typically a message is written or imprinted on a rectangular sheet of paper which is folded flat and placed in a wrapper ususally comprising a flat strip of paper which is flat folded over on itself in a rectangular manner with one edge of the rectangle being open like a slit so that the folded message may be inserted in the slit to be retained in the folded rectangle which is referred to as an envelope. The slit opening is appropriately closed, for example, by sealing a strip of paper thereover usually being an extension of one of the sides of the folded rectangle. Payment of a fee to the U.S. Postal Service for delivery of the message is placed on an outside surface of the envelope in the form of a small pertinent mark or stamp as an indicia of the authority of the U.S. Postal Service and/or payment of the required fee.

It is a practice in many parts of the U.S.A. that a wall panel or entry door of a building is provided with a narrow rectangular slot aperture therethrough. If the proposed recipient of the noted mail resides in the building or residence, a representative of the U.S. Postal Service inserts the envelope through the slot so that the resident may retrieve the envelope from inside the building. What has been described may be referred to as a slot delivery method which has a number of proven advantages, particularly to the aged and infirm resident who may recover their mail within their home thus precluding the necessity of having to leave the home, particularly in inclement weather to obtain their mail.

Along with the advantages there have been several disadvantages. For example, the mail introduced through the slot usually falls to the floor of a residence and, depending on the height of the slot from the floor, envelopes may be scattered about on the floor of the residence. Small rectangular parallel-piped packages may also be inserted in the mentioned slot. These packages may contain shock sensitive items which could then break when the package strikes the floor where the package could rupture and scatter its contents on the floor of the residence. Moreover, unless the slot is adequately covered in cold climates, a significant amount of cold air may enter or be driven through the slot and cool the interior of the residence to an undesirable level. In most instances the mail chute or slot includes a pivoting slot cover on the outside of the residence which is raised to insert mail into the slot and when lowered covers the slot to prevent the entry of rain, cold and dust laden air. Unfortunately, there is a tendency to attempt to insert excessive amount of mail into the slot or larger pieces of mail such as small packages. This practice results in the mail becoming wedged in the slot and partially protruding from the slot to retain the slot cover member or lid in an open or partially open manner and exposing the interior of the residence to outside climatic conditions.

DESCRIPTION OF THE PRIOR ART

A number of solutions have been proposed to overcome the above noted and other disadvantages.

For example, U.S. Pat. No. 491,509 which issued to H. E. Aldrich, Feb. 14, 1893, a hollow rectangular box member is proposed to be fastened to the inside of the door or wall which incorporates the mail slot. The box has an opening which covers the mail slot opening so that mail inserted into the slot is retained in the box. From inside the residence a latched door or lid in the box may be opened for easy retrieval of the mail.

U.S. Pat. No. 4,069,965 which issued to H. H. Maddox, Jr, Jan. 24, 1978, discloses a frame and pouch assembly which is attached to a mail slot frame at the interior of a residence or building. The pouch is translucent or transparent so that a person may readily perceive if any mail has been delivered to them, and if so, the pouch is easily detached from the frame to retrieve the mail.

OBJECTS OF THE INVENTION

It is an object of this invention to provide an improved mail slot attachement pouch which attached to a mail slot within a residence or building to collect and retain mail being inserted through the slot.

It is another object of this invention to provide a mail slot attachment pouch which is attached at a mail slot on the inside of a residence or buildling, the pouch being partly or wholly transparent to provide a visual indication of mail delivery.

It is a further object of this invention to provide an improved mail slot attachment comprising a transparent pouch which is attached inside a residence or building to a mail slot in a wall or door thereof to receive mail therein and close off the slot.

It is yet another object of this invention to provide an improved mail slot attachment receptacle comprising a transparent pouch which is attached within a residence or building to a mail slot on one side of the door or wall thereof to receive mail therein which is passed through the slot from the other side of the door or wall, the pouch having a closure member therein permitting ready opening of the pouch to retrieve the mail.

SUMMARY OF THE INVENTION

A generally narrow or slim parallel-piped pouch member has one small end wall removed to form an open-ended bag or pouch-like receptacle. The open end is fitted with a rectangular bracket having a rectangular opening therein which generally coincides with the open end of the pouch which is fitted to the bracket. The bracket is dimensioned so that it surrounds a mail chute or slot in a door or wall of a residence or building, and positions the pouch opening adjacent and in coincident alignment with the mail slot. The pouch material is a soft flexible material such as a synthetic resin material which is transparent or translucent, for example, polyethylene or polypropylene. The pouch includes a closure member, such as a zipper closure, along one side, and is also fitted with a flap to prevent air drafts from entering through the mail slot into the residence or building.

This invention will be better understood when taken in connection with the following description and drawings.

DESCRIPTION OF THE PREFERRED EMBODIMENT

Figure 1:
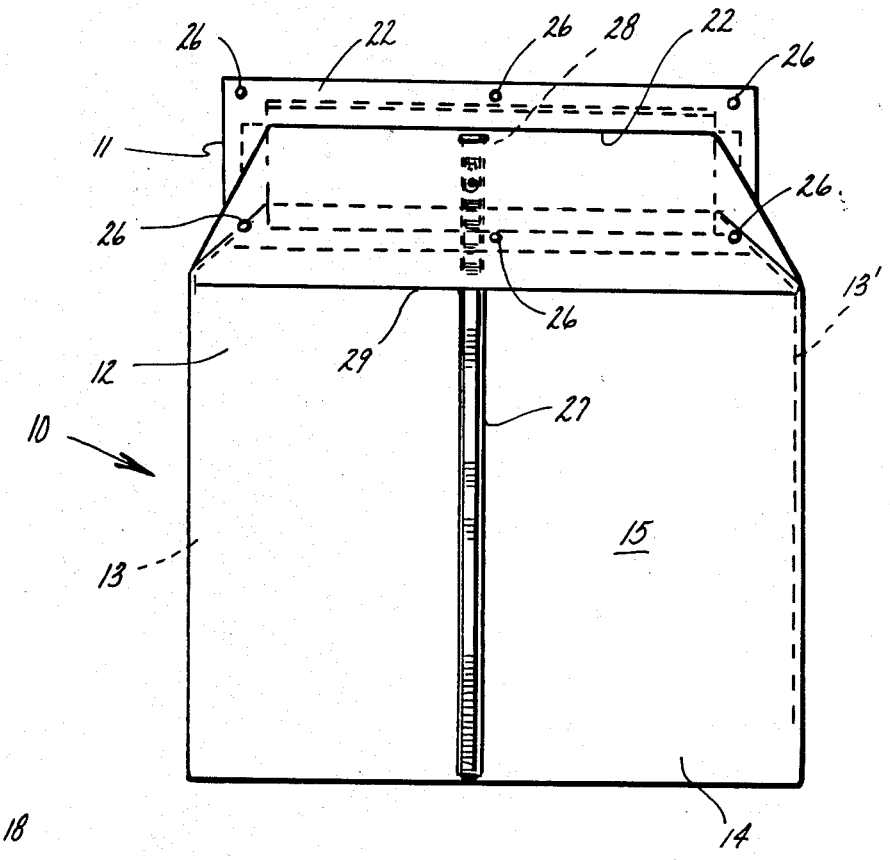
FIG. 1 is a frontal elevational view of one preferred embodiment of this invention in its operative position with respect to a mail slot.

Referring now to FIG. 1, the mail chute pouch 10 of this invention comprises a frame or bracket member 11 and a pouch body 12. Pouch body 12 is cut and/or folded from a relatively soft, easily flexible and foldable but tough and durable material such as a synthetic resin, leather, or cloth-like material.

Figure 2:
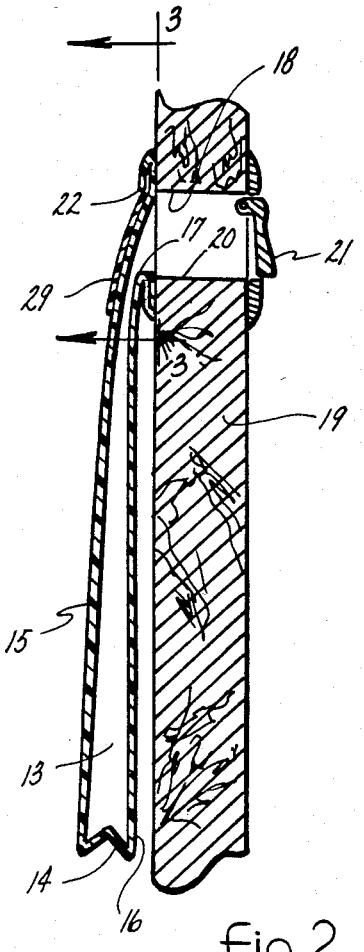
FIG. 2 is a cross-sectional side elevational view of the embodiment of FIG. 1 in its operative position adjacent a mail slot.

The material is cut and/or folded to provide the bag or pouch form as illustrated in FIGS. 1 and 2. One or more of the side and bottom panels 13, 13' and 14 may be separate panels suitably joined to front and back panels 15 and 16. Further, side and bottom panels 13, 13' and 14 may also be folded inwardly and therefore expansible to increase the useable volume of pouch 12 without the sides and bottom panels becoming excessively restrictive or constrictive with respect to the insertion of a larger amount of or more bulky articles of mail. Where the inside volume of pouch 12 is not a significant problem, pouch 12 may be constructed in a very flat form by eliminating the side and bottom panels, and bonding or joining front and back panels 15 and 16 together at their coincident perimeters, for example, by a heat bonding or sealing process. When pouch 12 material is a synthetic resin such as polyethylene resin, the material may be transparent or translucent to provide an immediate visual indication that mail has been delivered or received. Alternatively, only a small part of a panel, window part in, for example, front panel 15 may serve this purpose.

As is more clearly illustrated in FIGS. 1 and 2, pouch body 12 includes a closed bottom panel 14 and an upper open end 17. Open end 17 is adapted to cover a mail slot opening 18 in, for example, a panel 19 which may be an exterior door or wall section. Slot opening 18 is at one end of a rectangular mail slot 20 which passes through panel 19. Ordinarily, slot 20 is covered on the exterior side of panel 19, by a pivoting cover 21 which is pivoted away from slot 20 so that mail articles may be inserted therethrough into pouch 12.

Pouch 12 is equipped with a suitable attaching structure so that its open end 17 will surround and preferably cover opening 18 of mail slot 20. One such structure is shown in FIG. 1 as a mounting bracket or frame 11. Frame 11 is best described as a flat perimeter frame defining a concentric rectangular opening 22 therein.

Figure 3:
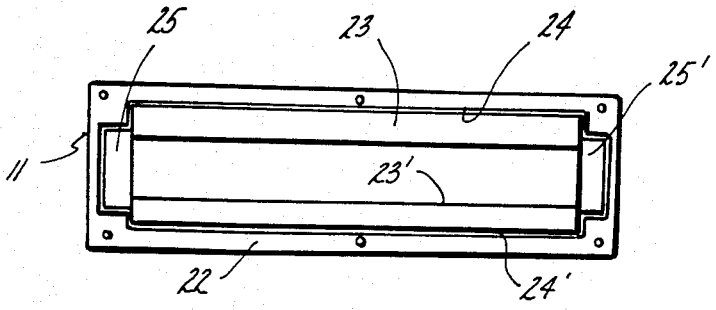
FIG. 3 is a view of the attachment of a pouch part of this invention to a mounting frame, taken along line 3—3 of FIG. 2.

As illustrated in FIGS. 2 and 3, one method for joining pouch 12 to frame 11 includes providing the open end 17 of pouch 12 with short lip extensions 23 and 23' which are parts of front and back panels 15 and 16, respectively. These extensions or lips 23 and 23' are inserted through opening 22 in frame 11 and then folded over to reside in recesses 24 and 24' in frame 11 and in that position may be glued or cemented to the recessed surface of recesses 24 and 24'. In this arrangement, frame opening 22 and the open end 17 of pouch 12 are in generally coincident alignment.

As shown in FIG. 2, the open end 17 of pouch 12 includes short lip extensions 23 and 23' of front panel 15 and back panel 16, respectively, which are inserted through frame opening 22 and then folded over to engage one side of frame 11 and may conveniently be joined thereto, for example, by a suitable glue or cement. In the same manner short side extensions 25 and 25' (FIG. 3) may be provided to fold under the shorter sides of frame 11.

As illustrated in FIGS. 1 and 2, frame 11 is dimensioned so that it surrounds slot opening 18 of slot 20. Open end 17 of pouch 12 is of the same size as slot 18 or preferably somewhat larger to be aligned with and surround opening 18. While frame 11 may have various dimensions, it is generally a practice to have the defined opening to be about 11 inches in the longer dimension or length and about 1.5 inches in the smaller dimension or width. Appropriate length and width dimensions for pouch 12 are about 16 inches and 14 inches, respectively.

With pouch 12 securely fastened to frame 11, frame 11 is positioned concentrically over aperture opening 18 and attached to panel 19. As illustrated in FIG. 1, one method of attaching frame 11 to panel 19 includes the use of a number of wood screws 26 which pass through suitable aperture in frame 11 and into panel 19. Sheet metal or self tapping screws may be employed where the panel is of a sheet metal construction. Alternately, if lip extensions 23, 23', 24 and 24' are fitted in suitable recesses, a very large smooth surface is available for use in gluing or cementing frame 11 to panel 19. Various high strength glues, cements and pressure sensitive tapes are available for this purpose.

The material of pouch 12 may be translucent or transparent synthetic resin material such as polypropylene or polyethylene. The transparency or translucence of part or all of pouch 12 material provides an immediate visual indication of mail having been delivered without any necessity of a recipient having to go elsewhere, perhaps to another building, to retrieve delivered mail. As an additional convenience, pouch 12 is fitted with a closure device which permits direct entry into pouch 12 to retrieve mail without the necessity of providing means to detach pouch 12 from frame 11. As illustrated in FIG. 1, one preferred closure device is illustrated as a zipper 27. Zipper device 27 may take the well known form of a row of closely spaced metallic projections or teeth affixed to one side of a slit opening and a row of closely spaced metallic locking/receiving elements affixed to the opposite side of a slit opening. A sliding cam member simultaneously grasps a part of the row of projections on one side of the slit opening and an opposite part of the row of receiving elements on the other side of the slit opening and glides along the rows exerting a camming action to force the projections in one side in locking engagement with the receptive elements on the other side.

The metallic elements as described may be replaced with a "C" cross-section groove formed in the material of pouch 12, and the projections on the other side with a circular cross-section rib of synthetic resin material. The cam member grasps appropriate pouch material forming the groove and rib and forces the rib into the groove by slightly enlarging the opening into the groove. The walls of the groove then securely grasp the rib along the length thereof to close the slit.

Zipper 27 can also be mounted along side panel 13' thereby eliminating the need for flap 29.

As previously noted, when a mail slot is utilized in the door of a residence, the mail slot (20 of FIG. 2) becomes a channel communicating with the interior of the residence and perhaps also with the weather conditions existing about the exterior of the residence. As a consequence, wind, rain and snow may be driven into the residence, a potentially very undesirable occurrence. In most instances, a pivoting cover 21 (FIG. 2) closes off the channel when no mail is being inserted in the mail slot. However, as previously noted, bulky items may wedge in slot 20 and prevent cover member 21 from closing off slot 20 to prevent egress of inclement weather conditions into the residence. Pouch 12 of this invention also serves to impede the egress of weather conditions into the residence, particularly drafts of cold air. However, when zipper 27 is employed, the zipper tab progressively moves into a very slightly open position forming gap 28 as a result of residual forces tending to open the zipper or slit at its opening end portion. In those instances where cover 21 does not effectively seal off slot 20 or where wind conditions may cause movement of cover 21, cold air may pass through slot 20 into pouch 12 and from pouch 12 through gap 28 into the interior of the residence or building. One means employed to prevent or impede this passage of air through the zipper gap opening 28 is illustrated in FIG. 2 as a flap 36.

Flap 29 is a rectangular strip of, for example, the same material as used for pouch 12. One long edge of flap 29 is inserted between frame 11 and panel 19, preferably in a deeper recess 25 therein which will accommodate the thickness of flap 29, as well as that of lip extension 24. Flap 29 is sufficiently large to extend significantly beyond gap 28 towards end panels 13 and 13' of pouch 12 as well as towards bottom panel 14. Because of the softness and flexibility of the flap material and pouch material the flap easily conforms to the irregularities of the pouch 12 as well as those of the zipper tab to impede progress of the described cold air through gap 28.

This invention thus provides a mail receiving pouch readily attachable to a panel member such as a residential door over a mail slot or chute in the door. The pouch receives any mail being passed through the slot and includes closure means therein which can be manipulated to provide entry into the pouch to receive the mail therefrom. In one embodiment of the invention the pouch material may be transparent or translucent or have a section thereof which is transparent or translucent to provide an immediate visual indication of delivered mail in the pouch.

While specific embodiments of this invention have been shown and described in detail to illustrate the inventive principles, it will be understood by those skilled in the art that the invention may be embraced otherwise without departing from those principles.

I claim:

1. A mail-receiving pouch for use with a mail slot in a panel or wall of a residence or building through which mail is inserted from one side of the panel or wall for delivery to the other side thereof, comprising the combination of:

a pouch member formed of a flexible material, the pouch member having integral lip means defining a first opening for receiving an article into the pouch member, the pouch member having a second opening and releasable attachment means for either closing the second opening, or for opening the second opening for removal of an article from the pouch;

an elongated rectangular frame member having an elongated rectangular opening therethrough, the frame member being disposed adjacent the lip means on the pouch member such that the lip means are sandwiched between the frame member and the panel about the mail slot; and fastener means for attaching the frame member and the lip means to the panel about the mail slot such that the first pouch opening is aligned with the mail slot for receiving an article into the pouch member;

whereby the article may be removed through the second opening in the pouch member without separating the pouch member from the panel.

2. The invention as recited in claim 1 wherein said pouch material is a synthetic resin material.

3. The invention as recited in claim 2 wherein said synthetic resin is polyethylene.

4. The invention as recited in claim 3 wherein at least a part of said pouch is sufficiently transparent to indicate that articles have been deposited therein.

5. The invention as recited in claim 4 wherein said pouch includes a longitudinal slit in a side thereof through which the contents of said pouch may be removed, and releasable securing means associated with said slit to close said slit and retain the contents of said pouch therein.

6. The invention as recited in claim 5 wherein said releasable securing means comprises a zipper closure.

7. The invention as recited in claim 6 wherein a rectangular flap member is attached to said frame member to depend therefrom and cover the opening end of said zipper.

* * * * *